US005303211A

United States Patent [19]

Yanaka et al.

[11] Patent Number: 5,303,211

[45] Date of Patent: Apr. 12, 1994

[54] WALL CLOCK

[75] Inventors: Makoto Yanaka; Hideo Irie, both of Tokyo, Japan

[73] Assignee: Seikosha Co., Ltd., Japan

[21] Appl. No.: 414,090

[22] Filed: Sep. 27, 1989

[30] Foreign Application Priority Data

Oct. 4, 1988 [JP] Japan ..... 63-130357[U]

[51] Int. Cl.[5] ..... G04B 19/00; G04B 19/04

[52] U.S. Cl. ..... 368/76; 368/80; 368/223

[58] Field of Search ..... 368/76, 80, 45, 220, 368/223, 228

[56] References Cited

U.S. PATENT DOCUMENTS

| | | | |
|---|---|---|---|
| 1,572,097 | 2/1926 | Walters . | |
| 1,676,030 | 7/1928 | Helin | 368/76 |
| 3,464,199 | 9/1969 | Scherz . | |
| 4,956,828 | 9/1990 | Yamada | 368/76 |
| 5,105,398 | 4/1992 | Hayakawa et al. | 368/80 |

*Primary Examiner*—Vit W. Miska

*Attorney, Agent, or Firm*—Bruce L. Adams; Van C. Wilks

[57] ABSTRACT

A wall clock has a first time increment portion comprising a stationary frame member. A timepiece movement is supported by the stationary frame member. A first wheel is rotatably driven by the timepiece movement, and a first time indicating member is rotatably driven by the timepiece movement for indicating a first time increment (i.e., hours). A belt is disposed around and driven by the first wheel. A second time increment portion rotatably supports a second wheel. The second wheel is rotatably driven by and suspended only by the belt, so that the second time increment portion is suspended only by the belt. A second time indicating member is rotatably driven by the second wheel for indicating a second time increment (i.e., minutes). The diameters of the first wheel and second wheel have a ratio of 12:1 so that the single timepiece movement can drive both the hour time indicating member (hour hand) and the minute time indicating member (minute hand) at appropriate speeds, through a simple and easy to manufacture construction.

11 Claims, 2 Drawing Sheets

WALL CLOCK

BACKGROUND OF THE INVENTION

1. Field of Industrial Use

The present device relates to a wall clock.

2. Prior Art

The conventional wall clock is constructed such that when it is hung on a wall or the like, a dial is fixed within a clock frame and two hands respectively fixed to their shafts extending from a timepiece movement behind the dial are rotated on the front surface of the dial, thereby displaying time.

The conventional wall clock of the above construction is excellent for display in time, but lacks interest of design because it has only a single lacks dial with hour and minute hands thereof rotating concentrically.

SUMMARY OF THE INVENTION

In view of the above condition, the present invention aims at providing a wall clock which is interesting from the point of view of design.

Means for solving Problems

The present invention features a timepiece movement that is arranged behind a stationary hour dial, an hour hand that is fixed to an hour-hand shaft extending from a timepiece movement and passing through the hour dial, a first wheel that is rotatably fixed to the hour dial, a second wheel that is suspended by a belt passing around the first wheel so as to rotate at an accelerated speed, a minute hand that is fixed to a rotary shaft of the second wheel and a minute dial that is arranged rotatably to the rotary shaft between the minute hand and the second wheel, and that provides a weight to the lower part.

Accordingly, an hour-based time display is performed by an hour dial and an hour hand, and a minute-based time display is performed by a minute dial and a minute hand. In this case, as the minute dial is spaced apart from a second wheel, it does not rotate but is held stationary.

BRIEF DESCRIPTION OF THE DRAWINGS

The drawings show one embodiment of the present device wherein.

DETAILED DESCRIPTION OF THE INVENTION

One embodiment of the present device will now be described in detail with reference to the accompanying drawings.

Figure 1:
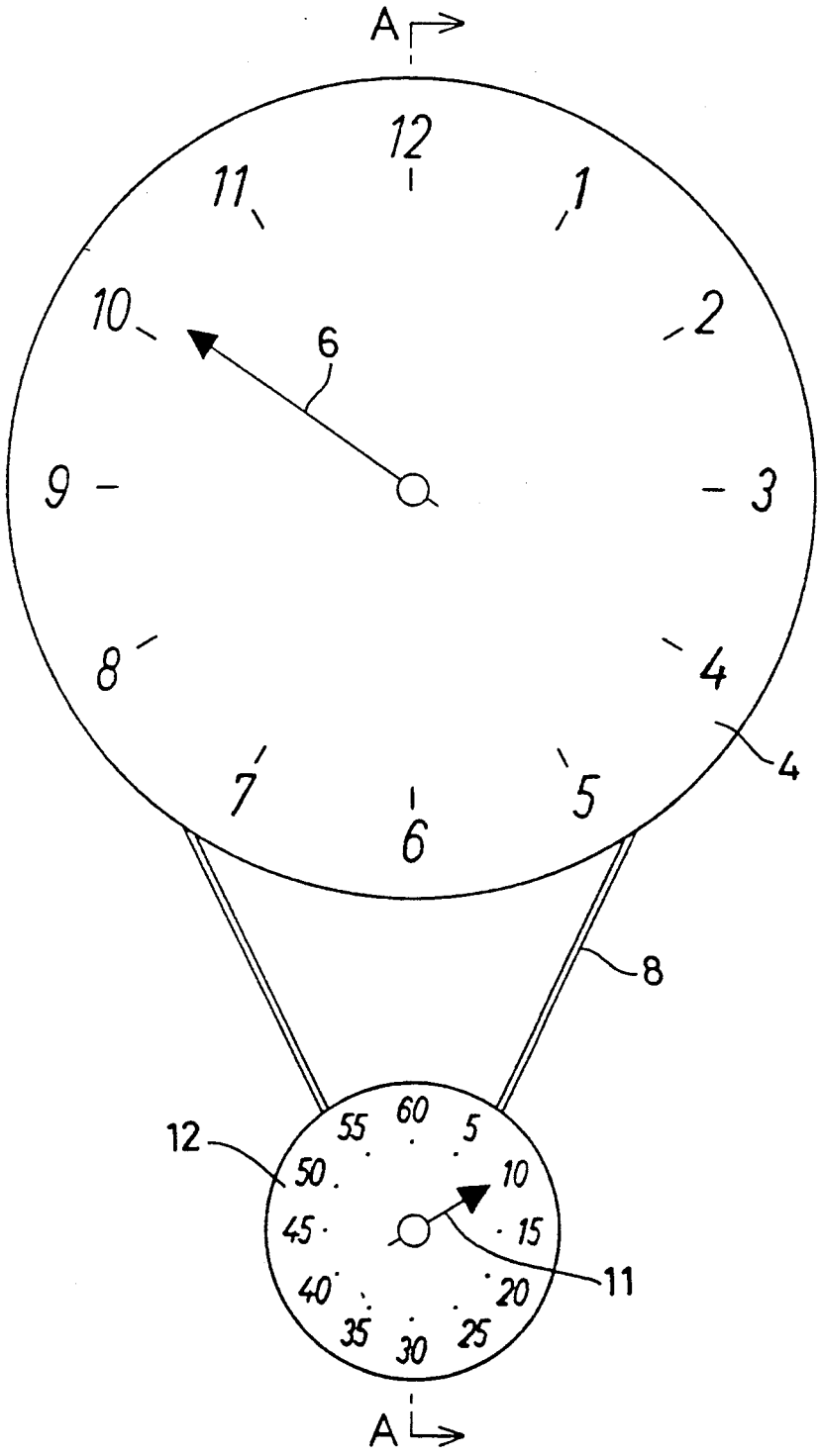
FIG. 1 is a front view of a wall clock.
Figure 2:
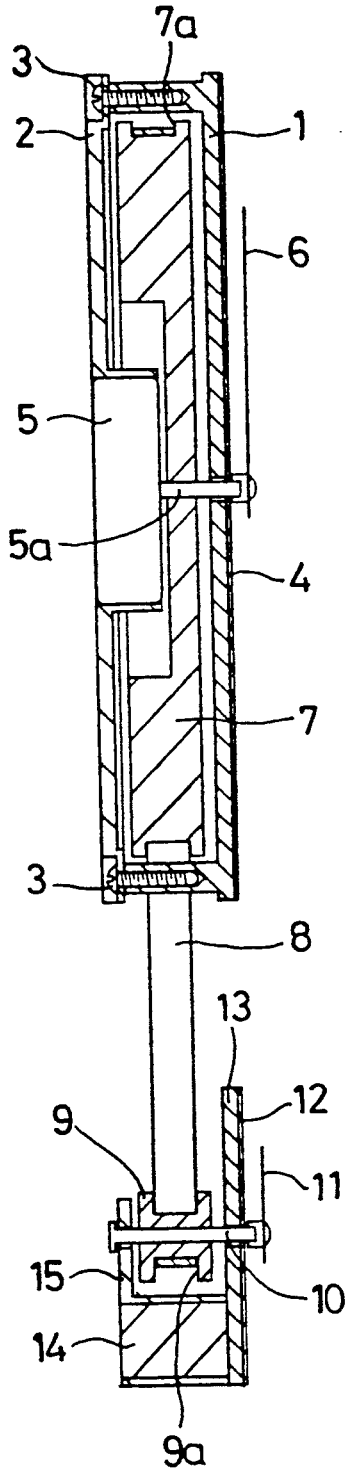
FIG. 2 is a cross-sectional view taken along the; A—A of FIG. 1.

As shown in FIGS. 1 and 2, a first time increment portion includes a front frame 1 and a rear frame 2 are coupled to each other through a screw 3. Further, to the front frame 1 there is applied an hour dial 4. And at the center of the rear frame 2 there is fixed a timepiece movement 5 from which an hour-hand shaft 5*a* projects passing through the hour dial 4 and the front frame 1. The hour hand shaft 5*a* has its top end pressure-fixed with a first time increment indicating member, an hour hand 6, on one hand and a first wheel 7 between the front and rear frames 1 and 2 on the other. The first wheel 7 is provided with a groove 7*a* on the outer periphery thereof through which a belt 8 is passed therearound. The belt 8 also passes around a groove 9*a* formed on the outer periphery of a second wheel 9, whereby a second time increment portion, which includes the second wheel 9, is held suspended with respect to the first wheel 7.

The diameter ratio of the first wheel 7 with respect to the second wheel 9 is 12:1, which results in that the torque on the first wheel 7 is transmitted to the second wheel 9 so as to allow the latter to rotate at an accelerated speed of 12 times that of the former.

The second wheel 9 is pressure-fixed with a rotary shaft 10 which has its one end (the right side in FIG. 2) pressure-fixed with a second time increment indicating member, minute hand 11.

Between the second wheel 9 and the minute hand 11 there is arranged a front plate 13 which is applied with a minute dial 12 and loosely fitted about the rotary shaft 10 allowing the latter to freely rotate. Further, to the lower part of the rear surface of the front plate 13 there is fixed a support member 15 provided with a weight 14 and one end of the rotary shaft 10 (the left side in FIG. 2) is loosely fitted in the upper part of the support 15. Consequently, the center of gravity of the minute dial 12 is directed downward due to the weight 14 attached thereto so that a minute marking [30] always lies at a lower position as shown in FIG. 1.

Accordingly, the torque from the timepiece movement 5 causes the hour hand to rotate through the hour-hand shaft 5*a* and time is displayed by hour-based graduations on the hour dial 4. At the same time, the second wheel 9 is rotated at an accelerated speed by the first wheel 7 fixed to the hour-hand shaft 5*a* causing the minute hand 11 to rotate through the rotary shaft 10 and time is displayed by minute-based graduations on the minute dial 12 by the indication of the minute hand 11.

FIG. 1 shows a state of the wall clock indicating 10 minutes after 10.

Further, it should be noted that although, in the instant embodiment, the hour hand is provided on the drive side and the minute hand, on the driven side, the present invention is not always limited thereto, and it is possible to reverse the positions of the hour and minute hands by varying the diameter ratio between the first and second wheels to 1 and 2.

Effects

With the above structure, the present device is able to provide a wall clock which operates differently from the conventional one and which is full of ideas allowing for a variety of designs due to the provision of separate dials.

We claim:

1. A clock comprising:

an hour dial;

a timepiece movement fixedly mounted to the dial and disposed behind the dial, wherein the movement includes a rotatable hour hand shaft projecting therefrom and through the dial;

an hour hand connected to the hour hand shaft in front of the dial;

a first wheel disposed behind the dial and rotatable with the hour hand shaft and having means therearound for receiving a belt;

a second wheel having means therearound for receiving a belt;

a belt disposed around the first and second wheels to suspend and rotate the second wheel in response to the rotation of the first wheel so that the second wheel is suspended only by the belt;

wherein the first and second wheels have diameters in a predetermined ratio to rotate the second wheel at a given number of rotations per rotation of the first wheel;

a minute hand shaft projecting from the second wheel and rotatable therewith;

a minute hand fixed to the minute hand shaft and rotatable therewith;

a minute dial disposed between the second wheel and the minute hand; and means connected to the minute dial to effect relative rotation between the minute hand shaft and the minute dial.

2. The clock according to claim 1, wherein the means connected to the dial comprises a weight at a lower portion thereof and wherein the minute hand shaft is freely rotatable in the minute dial.

3. A wall clock comprising: a stationary hour dial; a timepiece movement arranged behind the stationary hour dial; an hour hand shaft projecting from the timepiece movement through the stationary hour dial; an hour hand fixed to the hour hand shaft; a first wheel arranged behind the stationary hour dial and fixed to the hour hand shaft; a belt passing around the first wheel; a second wheel having a rotary shaft, the second wheel being suspended by the belt under the first wheel and rotatable by the belt at an accelerated speed; a minute hand fixed to the rotary shaft of the second wheel; a minute dial located between the minute hand and the second wheel; and a weight attached to the minute dial.

4. A wall clock comprising: a first time increment portion comprising a stationary frame member, a timepiece movement supported by the stationary frame member, a first wheel rotatably driven by the timepiece movement, and a first time indicating member rotatably driven by the timepiece movement for indicating a first time increment; a belt disposed around the first wheel; and a second time increment portion comprising a second wheel rotatably supported by the second time increment portion, the second wheel being rotatably driven by and suspended only by the belt so that the second time increment portion is suspended only by the belt, and a second time indicating member rotatably driven by the second wheel for indicating a second time increment.

5. A wall clock according to claim 4; wherein the second time increment portion further comprises a shaft fixed to the second wheel, and wherein the second time indicating member is fixed to the shaft fixed to the second wheel.

6. A wall clock according to claim 4; wherein the second time increment portion further comprises a dial having time indication markings, and a weight for preventing rotation of the dial.

7. A wall clock according to claim 4; wherein the first wheel has a diameter that has a ratio of 12:1 with a diameter of the second wheel.

8. A wall clock according to claim 4; wherein the second wheel has a diameter that has a ratio of 12:1 with a diameter of the first wheel.

9. A wall clock according to claim 4; wherein the first time increment portion further comprises an hour indicating dial, and the first time indicating member comprises an hour hand rotatably driven to indicate hours; and the second time increment portion further comprises a minute indicating dial, and the second time indicating member comprises a minute hand rotatably driven to indicate minutes.

10. A wall clock according to claim 4; wherein the first time increment portion further comprises a minute indicating dial, and the first time indicating member comprises a minute hand rotatably driven to indicate minutes; and the second time increment portion further comprises an hour indicating dial, and the second time indicating member comprises an hour hand rotatably driven to indicate hours.

11. A wall clock according to claim 4: wherein the timepiece movement includes a shaft rotatably driven by the timepiece movement, the first wheel being fixed to and rotatably driven by the shaft of the timepiece movement, and the first time indicating member being fixed to and rotatably driven by the shaft for indicating a first time increment.

* * * * *